US010850506B2

(12) United States Patent
Anderson et al.

(10) Patent No.: US 10,850,506 B2
(45) Date of Patent: Dec. 1, 2020

(54) DRIVE BUBBLE EVALUATION

(71) Applicant: HEWLETT-PACKARD DEVELOPMENT COMPANY, L.P., Spring, TX (US)

(72) Inventors: Daryl E Anderson, Corvallis, OR (US); Eric Martin, Corvallis, OR (US); James Michael Gardner, Corvallis, OR (US); Tsuyoshi Yamashita, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/462,298

(22) PCT Filed: Feb. 27, 2017

(86) PCT No.: PCT/US2017/019772

§ 371 (c)(1),
(2) Date: May 20, 2019

(87) PCT Pub. No.: WO2018/156170

PCT Pub. Date: Aug. 30, 2018

(65) Prior Publication Data

US 2019/0366709 A1 Dec. 5, 2019

(51) Int. Cl.
*B41J 2/045* (2006.01)
*B41J 29/38* (2006.01)

(52) U.S. Cl.
CPC ..... *B41J 2/04555* (2013.01); *B41J 2/0458* (2013.01); *B41J 29/38* (2013.01)

(58) Field of Classification Search
CPC .. B41J 2/04555; B41J 2/0458; B41J 2/16505; B41J 2/165; B41J 2/1652; B41J 2002/16594
See application file for complete search history.

(56) References Cited

U.S. PATENT DOCUMENTS 7,393,079 B2 7/2008 Ahne et al.
7,648,220 B2 1/2010 Farr et al.
7,681,990 B2 10/2010 Matsumoto
(Continued)

FOREIGN PATENT DOCUMENTS

JP 2012106405 A 6/2012
JP 2015061744 A 4/2015
(Continued)

OTHER PUBLICATIONS

Kwon, K. et al., Sensors and Actuators A: Physical, < http://inkjet.sch.ac.kr/wp-content/uploads/2015/08/inkjetmonitoringsystem.pdf >.

*Primary Examiner* — Thinh H Nguyen
(74) *Attorney, Agent, or Firm* — Mahamedi IP Law

(57) ABSTRACT

In some examples, a fluid ejection system can include one or more drive bubble devices and a sensor for each drive bubble device of the one or more drive bubble devices to detect a characteristic of each drive bubble device. The fluid ejection system can also include a controller. The controller can be configured to evaluate a first drive bubble device of the one or more drive bubble devices, and during the evaluation of the first drive bubble device, utilize one or more other drive bubble devices of the one or more drive bubble devices.

17 Claims, 7 Drawing Sheets

(56) References Cited

U.S. PATENT DOCUMENTS

| | | | | |
|---|---|---|---|---|
| 8,579,397 | B2 * | 11/2013 | Barss | B41J 2/12 347/9 |
| 2006/0139396 | A1 * | 6/2006 | Baker | B41J 2/165 347/22 |
| 2011/0084997 | A1 | 4/2011 | Chen et al. | |
| 2013/0278656 | A1 | 10/2013 | Govyadinov et al. | |
| 2014/0210897 | A1 | 7/2014 | Koehler et al. | |
| 2016/0167364 | A1 | 6/2016 | Matsumoto et al. | |
| 2017/0050428 | A1 | 2/2017 | Anderson et al. | |
| 2017/0050429 | A1 | 2/2017 | Anderson et al. | |

FOREIGN PATENT DOCUMENTS

| | | | |
|---|---|---|---|
| WO | WO 2015/116092 | A1 | 8/2015 |
| WO | WO-2015191060 | | 12/2015 |
| WO | WO 2016/175740 | A1 | 11/2016 |

* cited by examiner

DRIVE BUBBLE EVALUATION

BACKGROUND

Fluid ejection dies may be implemented in fluid ejection devices and/or fluid ejection systems to selectively eject/dispense fluid drops. Example fluid ejection dies may include nozzles, ejection chambers and fluid ejectors. In some examples, the fluid ejectors may eject fluid drops from an ejection chamber out of the nozzle.

BRIEF DESCRIPTION OF THE DRAWINGS

The disclosure herein is illustrated by way of example, and not by way of limitation, in the figures of the accompanying drawings in which like reference numerals refer to similar elements, and in which.

Figure 1A:
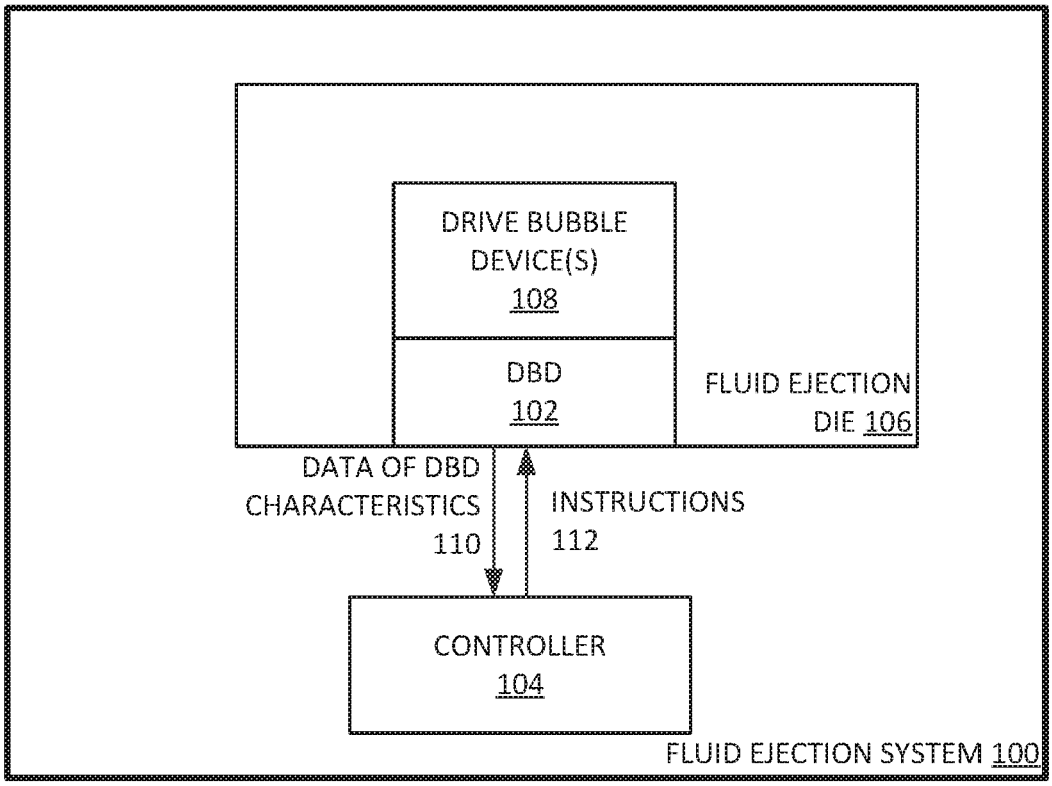
FIG. 1A illustrates an example fluid ejection system to evaluate a drive bubble device.

Throughout the drawings, identical reference numbers designate similar, but not necessarily identical elements. The figures are not necessarily to scale, and the size of some parts may be exaggerated to more clearly illustrate the example shown. Moreover the drawings provide examples and/or implementations consistent with the description. However, the description is not limited to the examples and/or implementations provided in the drawings.

DETAILED DESCRIPTION

Examples provide for a fluid ejection system to evaluate a fluid ejection die, to determine information relating to the operation (e.g., health, functionality) of the fluid ejection die. In some examples, a fluid ejection system can evaluate its fluid ejection die by making individual assessments of multiple drive bubble device in sequential fashion, while utilizing other drive bubble devices of the printer system. In some examples, the assessments are DBD (drive bubble detect) assessments.

Examples as described recognize that making an assessment of an entire fluid ejection die can be overly time consuming and burdensome for resources of a printer system. Additionally, the idle time resulting from assessment of the drive bubble devices can cause performance degradation, and sometimes, later assessed drive bubble devices may not be able to undergo assessment as a result of the idle time caused by assessments of other drive bubble devices. With printer systems that use latex, synthetic ink or other engineered fluidic inks, the issues of idle time during assessment of drive bubble devices are often exasperated, as such fluidic dyes tend to degrade more quickly than more conventional inks. Among other benefits, examples are described that enable the printer system to evaluate a drive bubble device on a fluid ejection die, while utilizing other drive bubble devices on the fluid ejection die.

System Description

FIG. 1A, illustrates an example printer system to evaluate a drive bubble device. As illustrated in FIG. 1A, fluid ejection system 100 can include controller 104 and fluid ejection die 106. Controller 104 can be configured to implement processes and other logic to manage operations of the fluid ejection system 100. For example, controller 104 can determine or evaluate the health and functionality of fluid ejection die 106 by controller 104 transmitting instructions 112 to DBD 102 to make assessments on drive bubble device(s) 108. Furthermore, while DBD 102 is making assessments on drive bubble device(s) 108, controller 104 can transmit instructions 112 to fluid ejection die 106 to concurrently implement servicing or pumping of other drive bubble device(s) 108. In some examples, controller 104 can transmit instructions 112 to fluid ejection die 106 to fire/eject fluid out of drive bubble device(s) 108. As herein described, any fluid, for example ink, can be used can be fired out of drive bubble device(s) 108. In other examples, controller 104 can transmit instructions 112 to fluid ejection die 106 to implement servicing or pumping of drive bubble device(s) 108. In some examples, controller 104 can include one or more processors to implement the described operations of fluid ejection system 100.

Drive bubble device(s) 108 can include a nozzle, a fluid chamber and a fluid ejection component. Each drive bubble device can receive fluid from a fluid reservoir. In some examples, the fluid reservoir can be ink feed holes or an array of ink feed holes. In some examples, the fluid can be ink (e.g. latex ink, synthetic ink or other engineered fluidic inks).

Fluid ejection system 100 can fire fluid from the nozzle of drive bubble device(s) 108 by forming a bubble in the fluid chamber of drive bubble device(s) 108. In some examples, the fluid ejection component can include a heating source. As such, fluid ejection system 100 can form a bubble in the fluid chamber by heating the fluid in the fluid chamber with the heat source of drive bubble device(s) 108. The bubble can drive/eject the fluid out of the nozzle, once the bubble gets large enough. In some examples, controller 104 can transmit instructions 112 to fluid ejection die 106 to drive a signal (e.g. power from a power source or current from the power source) to the heating source in order to create a bubble in the fluid chamber (e.g. fluid chamber 202). Once the bubble in the fluid chamber gets big enough, the fluid in the fluid chamber can be fired/ejected out of the nozzles of drive bubble device(s) 108.

In some examples, the heating source can include a resistor (e.g. a thermal resistor) and a power source. In such examples, controller 104 can transmit instructions 112 to fluid ejection die 106 to drive a signal (e.g. power from a power source or current from the power source) to the resistor of the heating source. The longer the signal is applied to the resistor, the hotter the resistor becomes. As a result of the resistor emitting more heat, the hotter the fluid gets resulting in the formation of a bubble in the fluid chamber.

Fluid ejection system 100 can make assessments of drive bubble device(s) 108 by electrically monitoring drive bubble device(s) 108. Fluid ejection system 100 can electrically monitor drive bubble device(s) 108 with DBD 102 and a nozzle sensor or DBD sensing component operatively communicating with drive bubble device(s) 108. DBD sensing component can be a conductive plate. In some examples DBD sensing component can be a tantalum plate.

In some examples, DBD 102 may electrically monitor the impedance of the fluid in drive bubble device(s) 108, during the formation and dissipation of the bubble in drive bubble device(s) 108. For instance, DBD 102 can be operatively connected to a DBD sensing component that itself is operatively connected to the fluid chamber of drive bubble device 108. In such a configuration, DBD 102 can drive a signal or stimulus (e.g. current or voltage) into the DBD sensing component in order to detect response signals (e.g. response voltages) of the formation and dissipation of the bubble in a drive bubble device. If the fluid chamber is empty, the remaining air has a high impedance, meaning the detected voltage response would be high. If the fluid chamber had fluid, the detected voltage response would be low because the fluid at a completely liquid state has a low impedance. If a steam bubble is forming in the fluid chamber, while a current is driven into the DBD sensing component, the detected voltage response would be higher than if the fluid in the fluid chamber were fully liquid. As the heating source gets hotter and more fluid vapors are generated, the voltage response increases because the impedance of the fluid increases. The detected voltage response would climax when the fluid from the fluid chamber is ejected from the nozzle. After which, the bubble dissipates and more fluid is introduced into the fluid chamber from reservoir.

In some examples, DBD 102 can drive the current (to the DBD sensing component) at precise times in order to detect one or more voltage responses, during the formation and dissipation of a bubble in the fluid chamber. In other examples, DBD 102 can drive a voltage to the DBD sensing component and monitor the charge transfer or voltage decay rate, during the formation and dissipation of a bubble in the fluid chamber 202.

Fluid ejection system 100 can determine the state of operability of the components of the drive bubble device, based on the assessments. In some examples, the data of the detected signal response(s) can be compared with a DBD signal response curve. In some examples, the signal response(s) are voltage responses. In other examples, the signal response(s) are the charge transfer or voltage decay rate. Based on the comparison, fluid ejection system 100 can determine the state of operability of the drive bubble device being DBD assessed (e.g. whether the components of the drive bubble device are working properly).

For example, controller 104 can determine the state of operability of drive bubble device(s) 108, based on data of DBD characteristics 110 transmitted from DBD 102. In some examples, data of DBD characteristics 110 includes the data of signal responses detected by from DBD 102 of drive bubble device(s) 108. Furthermore, controller 104 can compare data of signal responses to a DBD signal response curve. In some examples, the DBD signal response curve can include a signal response curve of a full functioning drive bubble device. If the data of signal responses is similar to the signal response curve of the full functioning drive bubble device, then controller 104 can determine that the DBD assessed drive bubble device 108 is working properly. On the other hand, if the data of signal responses and the signal response curve of the full functioning drive bubble device are not similar, then controller 104 can determine that the DBD assessed drive bubble device 108 is not working properly. In yet other examples, controller 104 can compare the data of signal responses to a signal response curve of a drive bubble device not working properly. If the data of signal responses and the signal response curve of the drive bubble device not working properly are similar, then controller 104 can determine that the DBD assessed drive bubble device 108 is not working properly.

Fluid ejection die 106 can include columns of drive bubble devices 108. In some examples, fluid ejection die 106 can include a column of drive bubble devices 108. Making a DBD (drive bubble detect) assessment of an entire fluid ejection die can take too long and the later assessed drive bubble devices on the fluid ejection die may have been idle too long and become too degraded to be able to undergo an assessment. One approach to combat this problem, is by halting assessment of the entire fluid ejection die to service (e.g. eject/pump fluid currently in the drive bubble device or recirculate the fluid currently in the drive bubble device) the degraded drive bubble device. However such an approach extends the time for assessment and can even contribute to the degradation of the drive bubble device to degrade further. In some examples, fluid ejection system 100 can simultaneously perform an assessment of drive bubble device 108 and service the remaining drive bubble devices 108 not undergoing assessment. In other examples, printer device 100 can simultaneously perform an assessment of one drive bubble device 108 of one column of drive bubble devices and service all drive bubble devices 108 of the remaining columns not selected for assessment.

In some examples, fluid ejection system 100 can perform assessments on all drive bubble devices 108 on fluid ejection die 106. In other examples, fluid ejection system 100 can perform assessments on some of drive bubbles 108 on fluid ejection die 106. In yet other examples, fluid ejection system 100 can determine whether or not to perform assessments on all drive bubble devices 108, based on the current resources of fluid ejection system 100.

Figure 1B:
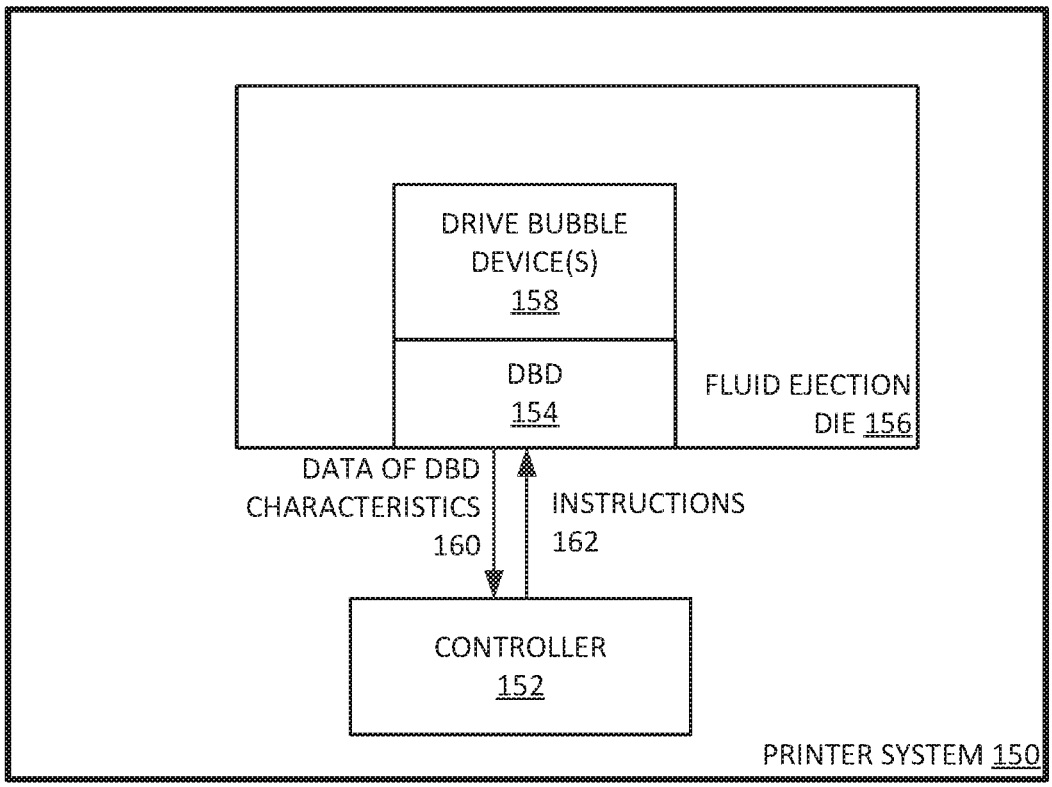
FIG. 1B illustrates an example printer system to evaluate a drive bubble device.

In some examples, fluid ejection die system 100 can be a printer system. FIG. 1B illustrates an example printer system to evaluate a drive bubble device. As illustrated in FIG. 1B, printer system 150 can include modules/components similar to fluid ejection system 100. For example, printer system 150 can include controller 152 and fluid ejection die 156. Controller 152 can be configured to be configured to implement processes and other logic to manage operations of fluid ejection die 156. For example, controller 152 can evaluate the health and functionality of fluid ejection die 156 by controller 152 making assessments on drive bubble device(s) 158. Furthermore, while controller 152 is making assessments on drive bubble device(s) 158, controller 152 can instruct fluid ejection die 156 to concurrently implement servicing or pumping of other drive bubble device(s) 158.

Figure 2:
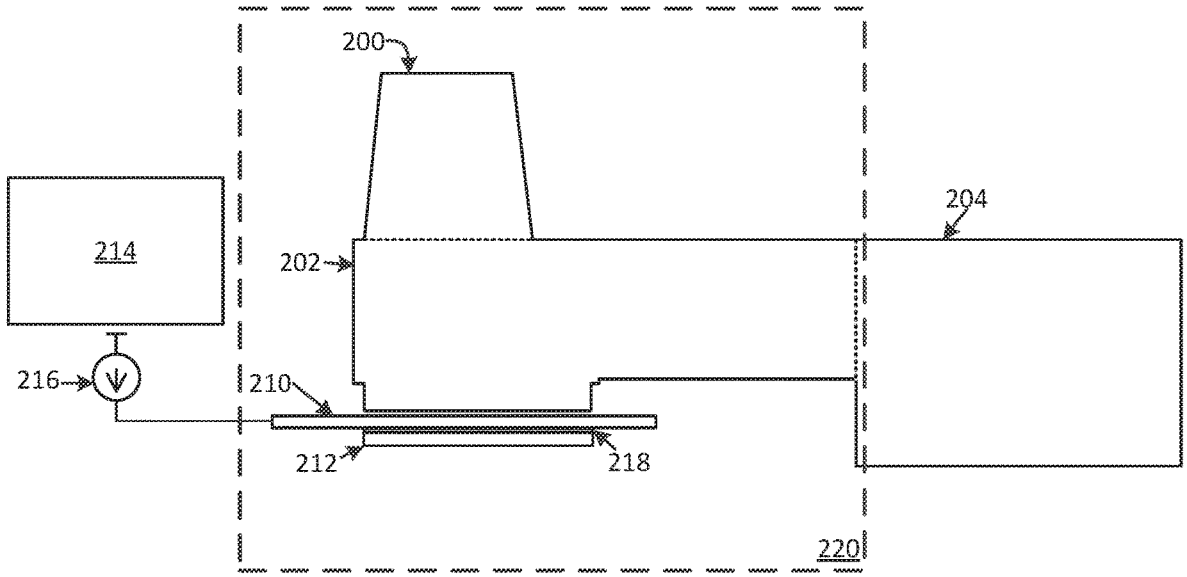
FIG. 2 illustrates an example cross-sectional view of an example drive bubble device including a nozzle, a nozzle sensor, and nozzle sensor control logic.

FIG. 2 illustrates an example cross-sectional view of an example drive bubble device including a nozzle, a nozzle sensor, and nozzle sensor control logic. As illustrated in FIG. 2, drive bubble device 220 includes nozzle 200, ejection chamber 202, and fluid ejector 212. In some examples, as illustrated in FIG. 2, fluid ejector 212 may be disposed proximate to ejection chamber 202.

Drive bubble device 220 can also include a DBD sensing component 210 operatively coupled to and located below fluid chamber 202. DBD sensing component can be a conductive plate. In some examples DBD sensing component 210 is a tantalum plate. As illustrated in FIG. 2, DBD sensing component 210 can be isolated from fluid ejector 212 by insulating layer 218.

In some examples, a fluid ejection die, such as the example of FIG. 1A, may eject drops of fluid from ejection chamber 202 through a nozzle orifice or bore of the nozzle 200 by fluid ejector 212. Examples of fluid ejector 212 include a thermal resistor based actuator, a piezo-electric membrane based actuator, an electrostatic membrane actuator, magnetostrictive drive actuator, and/or other such devices.

In examples in which fluid ejector 212 may comprise a thermal resistor based actuator, a controller can instruct the fluid ejection die to drive a signal (e.g. power from a power source or current from the power source) to electrically actuate fluid ejector 212. In such examples, the electrical actuation of fluid ejector 212 can cause formation of a vapor bubble in fluid proximate to fluid ejector 212 (e.g. ejection chamber 202). As the vapor bubble expands, a drop of fluid may be displaced in ejection chamber 202 and expelled/ejected/fired through the orifice of nozzle 200. In this example, after ejection of a fluid drop, electrical actuation of fluid ejector 212 may cease, such that the bubble collapses. Collapse of the bubble may draw fluid from fluid reservoir 204 into ejection chamber 202. In this way, in some examples, a controller (e.g. controller 104) can control the formation of bubbles in fluid chamber 202 by time (e.g. longer signal causes hotter resistor response) or by signal magnitude or characteristic (e.g. greater current on resistor to generate more heat).

In examples in which the fluid ejector 212 includes a piezoelectric membrane, a controller can instruct the fluid ejection die to drive a signal (e.g. power from a power source or current from the power source) to electrically actuate fluid ejector 212. In such examples, the electrical actuation of fluid ejector 212 can cause deformation of the piezoelectric membrane. As a result, a drop of fluid may be ejected out of the orifice of nozzle 200 due to the deformation of the piezoelectric membrane. Returning of the piezoelectric membrane to a non-actuated state may draw additional fluid from fluid reservoir 204 into ejection chamber 202.

Examples described herein may further comprise a nozzle sensor or DBD sensing component 210 disposed proximate ejection chamber 202. DBD sensing component 210 may sense and/or measure characteristics associated with the nozzle 200 and/or fluid therein. For example, the nozzle sensor 210 may be used to sense an impedance corresponding to the ejection chamber 202. In such examples, the nozzle sensor 210 may include a first sensing plate and second sensing plate. In some examples DBD sensing component 210 is a tantalum plate. As illustrated in FIG. 2, DBD sensing device 210 can be isolated from fluid ejector 212 by insulating layer 218. Based on the material disposed between the first and second sensing plates, an impedance may vary. For example, if a vapor bubble is formed proximate the nozzle sensor 210 (e.g. in fluid chamber 202), the impedance may differ as compared to when fluid is disposed proximate the DBD sensing component 210 (e.g. in fluid chamber 202). Accordingly, formation of a vapor bubble, and a subsequent collapse of a vapor bubble may be detected and/or monitored by sensing an impedance with the DBD sensing component 210.

A fluid ejection system can make assessments of drive bubble device 220 and determine a state of operability of the components of drive bubble device 220 (e.g. whether the components of drive bubble device 220 are working properly). For example, as illustrated in FIG. 2, nozzle sensor control logic 214 (including current source 216) can be operatively connected to DBD sensing component 210 to monitor characteristics of the drive bubble device, during the formation and dissipation of the a bubble in fluid chamber 202. For instance, some examples, nozzle sensor control logic 214 can be operatively connected to DBD sensing component 210 to electrically monitor the impedance of the fluid in fluid chamber 202, during the formation and dissipation of the bubble in fluid chamber 202. Nozzle sensor control logic 214 can drive a current from current source 216 into DBD sensing component 210 to detect a voltage response from fluid chamber 202 during the formation and dissipation of a bubble. In some examples, nozzle sensor control logic 214 can drive the current (to DBD sensing component 210) at precise times in order to detect one or more voltage responses, during the formation and dissipation of a bubble in fluid chamber 202. In other examples, nozzle sensor control logic 214 can drive a voltage to DBD sensing component 210 and monitor the charge transfer or voltage decay rate, during the formation and dissipation of a bubble in fluid chamber 202. Nozzle sensor control logic 214 can transmit data related to the voltage responses to a controller (e.g. controller 104) of the fluid ejection system (e.g. fluid ejection system 100). Similar to the principles described earlier, the controller can then determine the state of operability of drive bubble device 200, based on the received data. In some examples, nozzle sensor control logic 214 can include DBD circuitry.

Methodology

Figure 3A:
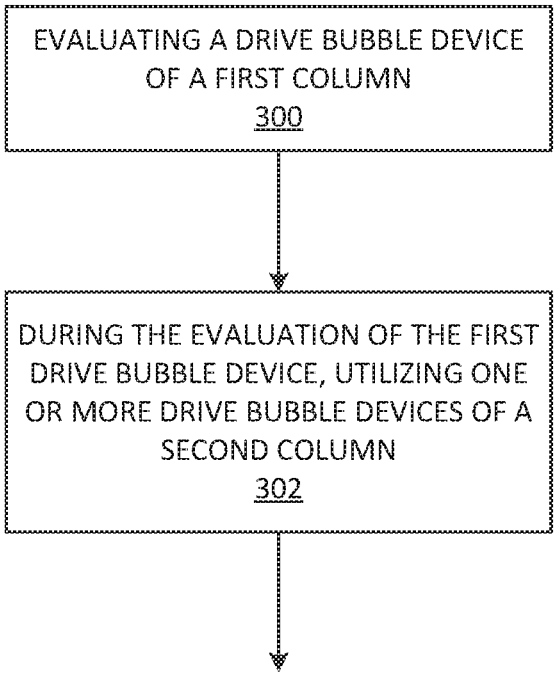
FIG. 3A illustrates an example method for evaluating a drive bubble device on an example fluid ejection system.
Figure 3B:
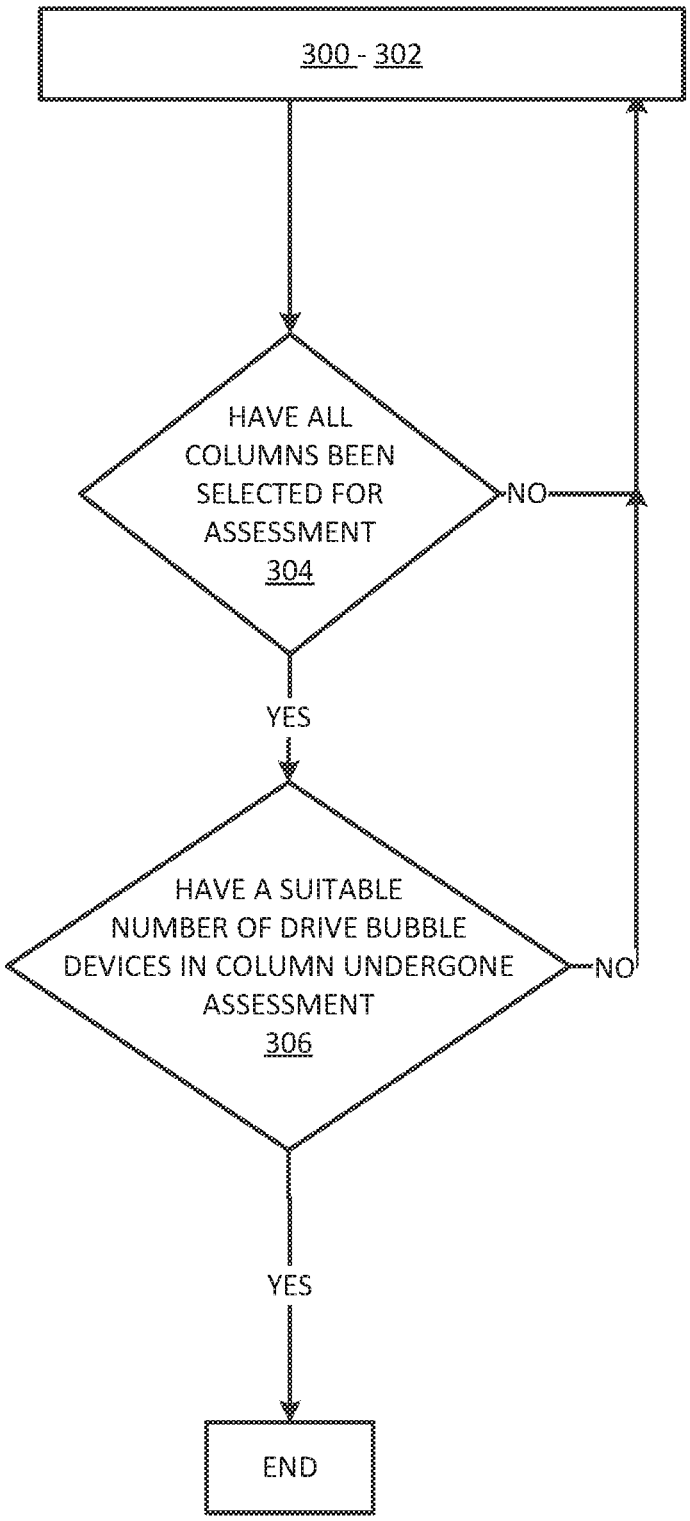
FIG. 3B illustrates an example method for evaluating a drive bubble device on an example fluid ejection system using a round-robin process.

FIG. 3A illustrates an example method for evaluating a drive bubble device on an example fluid ejection system. FIG. 3B illustrates an example method for evaluating a drive bubble device on an example fluid ejection system using a round-robin process. As herein described a firing event is when a drive bubble device ejects/fires fluid and undergoes Assessment. In the below discussions of FIG. 3A and FIG. 3B may be made to reference characters representing like features as shown and described with respect to FIG. 1A, FIG. 1B and/or FIG. 2 for purposes of illustrating a suitable component for performing a step or sub-step being described.

FIG. 3A illustrates an example method for evaluating a drive bubble device on an example fluid ejection system. In some examples, fluid ejection system 100 can evaluate a first drive bubble device of a first column of drive bubble devices (300). For example, fluid ejection system 100 can transmit instructions 112 to fluid ejection die 106 to DBD assess one drive bubble device 108 of a first column of drive bubble devices 108 on fluid ejection die 106.

In some examples, prior to the fluid ejection system evaluating the first drive bubble device of a first column of drive bubble devices, the fluid ejection system can select a column, and a specific drive bubble device of the selected column, in order to determine the drive bubble device for assessment. For example, controller 104 can transmit instructions 112 to fluid ejection die 106 to select one column for assessment, while the drive bubble device of another column is in use, and without evaluating other drive bubble devices of the selected column. After controller 104 selects a column, controller 104 can transmit instructions 112 to fluid ejection die 106 to select a specific drive bubble device 108 of the currently selected column to undergo assessment.

Figure 4A:
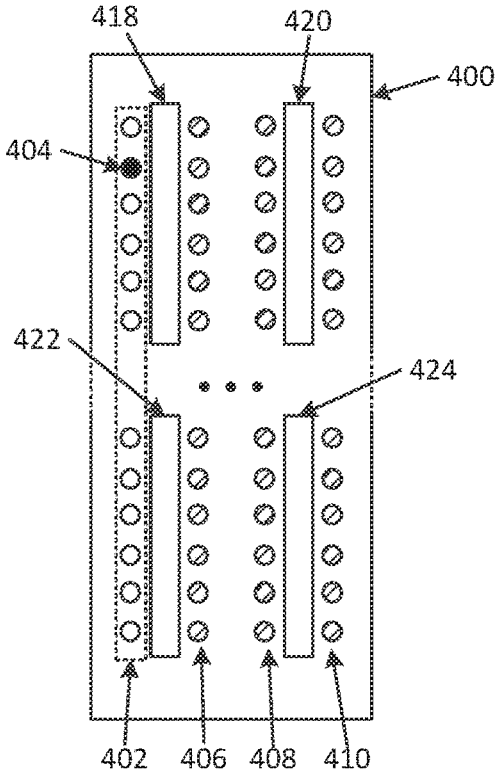
FIGS. 4A-4D illustrates an example fluid ejection die evaluating a drive bubble device while utilizing other drive bubble devices.

An example of fluid ejection die 106 selecting a specific drive bubble device to undergo Assessment is illustrated in FIG. 4A-4D. FIGS. 4A-4D illustrates an example fluid ejection die evaluating a drive bubble device while utilizing other drive bubble devices. Example fluid ejection die 400 includes 4 columns —402, 406, 408 and 410. Each drive bubble device of each column can be adjacent to an ink reservoir. For example as illustrated in FIG. 4A (as well as FIGS. 4B-4D), each column is adjacent to ink reservoir 418, 420, 422 and 424. In some examples, ink reservoir 418, 420, 422 and 424 can each be an ink feedhole or each an array of ink feedholes. As illustrated in FIG. 4A, a controller (e.g. controller 104) can instruct fluid ejection die 400 to select column 402 for assessment. The fluid ejection die 400 may then select the drive bubble device 404 for assessment. The remaining drive bubble devices of column 402 do not undergo assessment.

In some examples, prior to the evaluation of the first drive bubble device, printer system 100 (e.g. controller 104) can transmit to fluid ejection die 106 instructions 112 that can include DBD data. The DBD data can indicate which drive bubble devices of the selected column are to undergo assessment and which drive bubble device are not. In some examples, DBD data can include firing instructions (instructions that cause a drive bubble device to eject/fire fluid for assessment) and non-firing instructions (instructions that cause a drive bubble device to not eject fluid).

During the evaluation of the first drive bubble device, the fluid ejection system can utilize one or more drive bubble devices of a second column of the fluid ejection die (302). In some examples, fluid ejection system 100 can transmit instructions 112 to fluid ejection die 106 to initiate the firing event of the selected drive bubble device 108. Furthermore, in those examples, before or during the firing event of selected drive bubble device 108, fluid ejection system 100 can transmit instructions 112 to fluid ejection die 106 to utilize or service drive bubble devices 108 of the other columns not selected for assessment, during the firing event. As illustrated in FIG. 4, fluid ejection die 400 can be instructed by fluid ejection system (e.g. by controller 104 transmitting instructions 112 to fluid ejection die 400) to initiate a fire event with drive bubble device 404. Before or during the firing event, the fluid ejection system (e.g. controller 104) can transmit instructions 112 to fluid ejection die 400 to service (e.g. eject/pump ink currently in the drive bubble device or recirculate the ink currently in the drive bubble device) all or some of the drive bubble devices in columns 406, 408 and 410, during the firing event.

In some examples instruction 112 can include service data. In these examples, prior to the fire event, controller 104 can upload service data to fluid ejection die 106. The service data can instruct fluid ejection die 106 which drive bubble device(s) 108 to be serviced (e.g. the drive bubble devices of the remaining columns not selected for Assessment). Service data can also include pump data or spit data. Pump data instructs fluid ejection die 106 to recirculate fluid in its drive bubble devices 108 (assuming the drive bubble device is fitted with a recirculation pump), while spit data instructs fluid ejection die 106 to eject fluid currently its drive bubble devices 108.

Based on the evaluation or assessment of the first drive bubble device, the fluid ejection system can determine a state of operability of the DBD assessed first drive bubble device (e.g. whether the components of the first drive bubble device are working properly). In some examples, fluid ejection system 100 (e.g. controller 104) can determine the state of operability of the DBD assessed drive bubble device 108, using previously described principles. For example, DBD 102 can transmit data of the detected response signals to controller 104. After which, controller 104 can compare the data of detected response signals to a signal response curve. Based on the comparison, the controller 104 can determine a state of operability of the DBD assessed drive bubble device 108.

With reference to FIG. 3B, the fluid ejection system can continue assessment in round-robin fashion to for other drive bubble devices of other columns, until a suitable number of the drive bubble devices have undergone assessment. More specifically, the fluid ejection system can determine whether all the columns of the fluid ejection die have been selected for assessment (308). If the fluid ejection system determines that not all the columns of the fluid ejection die have been selected for assessment, then the fluid ejection system can select another column of the fluid ejection die to undergo assessment.

Figure 4B:
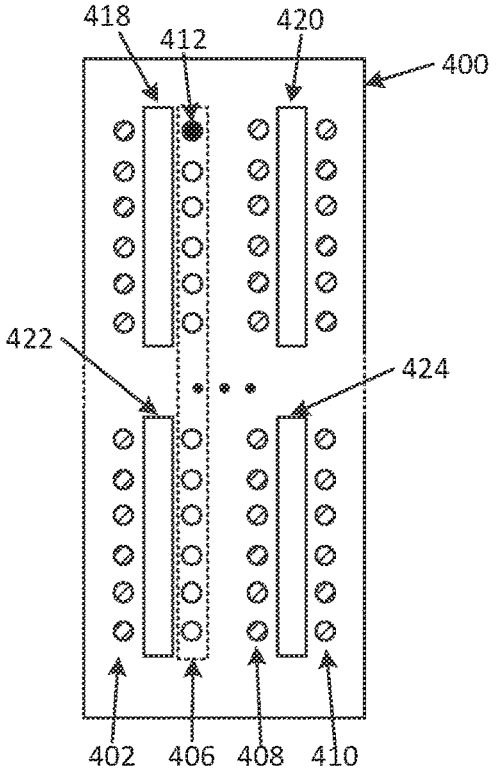
Figure 4C:
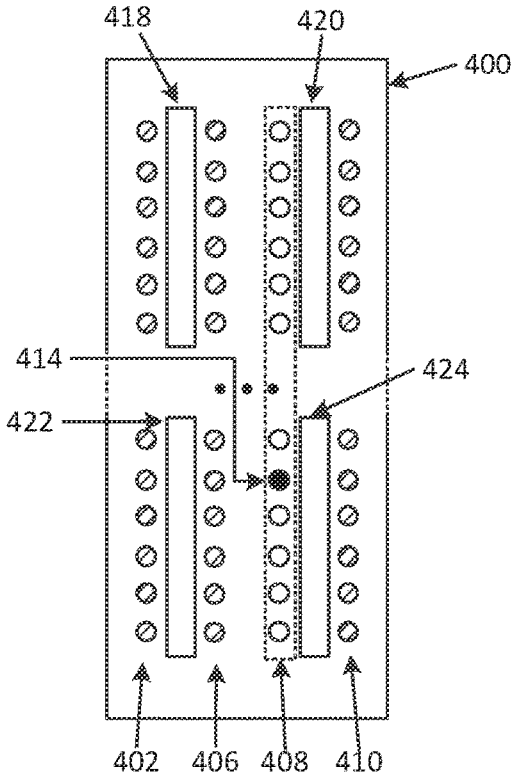
Figure 4D:
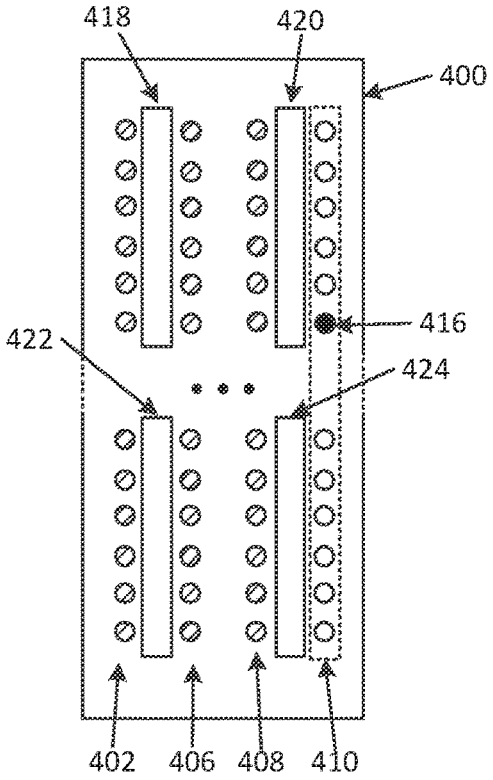

In some examples, controller 104 selects the next selected column that is different from the previously selected column. For example, as illustrated in FIG. 4B, the fluid ejection system (e.g. controller 104) instructs fluid ejection die 400 to select column 406 is instead of 402. In other examples, as illustrated in FIG. 4C, column 408 is selected instead of column 402 and column 406. In yet other examples, as illustrated in FIG. 4D, column 410 is selected instead of column 402, column 406 and column 408. The next selected column can undergo the same methodology as described for and illustrated in FIG. 3A. For example, as illustrated in FIG. 4B, the fluid ejection system (e.g. controller 104) instructs fluid ejection die 400 to select drive bubble device 412 of column 406 for assessment. Furthermore, the fluid ejection system (e.g. controller 400) instructs fluid ejection die 400 to not eject/fire ink the remaining drive bubble devices of column 406 during the firing event. Additionally, the fluid ejection system (e.g. controller 104) can instruct fluid ejection die 400 to initialize the next firing event with drive bubble device 412, while concurrently servicing some or all of the remaining drive bubble devices of the columns not selected for assessment. Based on the assessment of drive bubble 412, the fluid ejection system (e.g. controller 104) can determine the operability of drive bubble 412.

In some examples the selection process of the next column to be selected for assessment can be random (e.g. 402-410-406-408-406-402-etc.). In other examples the selection process of the next column to be selected for assessment can be sequential (e.g. 402-406-408-410-402-406-etc.), or even patterned (e.g. 402-410,406-408-402-410-406-408-etc.).

If all the drive bubble devices of the columns of the fluid ejection die have been selected for assessment, the fluid ejection system can determine whether a suitable number of the drive bubble devices of all the columns have undergone assessment (310). In some examples, the fluid ejection system determines that the suitable number of drive bubble devices to undergo assessment of each column is based on the current resources of the fluid ejection system. In other examples the fluid ejection system can DBD assess all of the drive bubble devices of all the columns. For example if the fluid ejection system determines that not all the drive bubble devices of all columns of the fluid ejection die have been selected for assessment, then the fluid ejection system can reselect a column of the fluid ejection die that has already been selected for assessment but has drive bubble devices that have not undergone assessment. For example, fluid ejection system 100 determines that not all drive bubble devices 108 of all the columns of fluid ejection die 106 have undergone assessment. Based on that determination, fluid ejection system 100 (e.g. controller 104) can transmit instructions 112 to fluid ejection die 106 to select the next column for assessment based on a random process, a sequential process, or even in a patterned process (as similarly described above).

The next selected column can undergo the same methodology as described for and illustrated in FIG. 3A, so long as the next selected drive bubble device has not undergone assessment. In some examples, selection of the next drive bubble device 108 in a column that has already been selected for assessment can be random. For example, as illustrated in FIG. 4A the first drive bubble device to be selected for assessment can be drive bubble device 404. After all the columns have been selected for assessment, the fluid ejection system (e.g. controller 104) determines that not all of the drive bubble devices of the columns of the fluid ejection die have undergone assessment. Based on that determination, the fluid ejection system (e.g. controller 104) instructs fluid ejection die 400 to select column 402 for assessment again (e.g. either randomly, sequentially or based on a patterned process). Additionally, the fluid ejection system (e.g. controller 104) can instruct fluid ejection die 400 to randomly select the next drive bubble device to undergo assessment, so long as the next selected drive bubble device has not undergone assessment (e.g. the drive bubble device that is two drive bubble devices below drive bubble device 404).

In other examples, the fluid ejection system can select the next drive bubble device sequentially. For example, the fluid ejection system (e.g. controller 104) can initially select the drive bubble devices at the top of each column to undergo assessment. After all the columns have been selected for assessment, the fluid ejection system (e.g. controller 104) determines that not all of the drive bubble devices of the columns of the fluid ejection die have undergone assessment. Based on that determination, the fluid ejection system (e.g. controller 104) instructs fluid ejection die 400 to select column 402 for assessment again (e.g. randomly, sequentially or based on a patterned process). Additionally, the fluid ejection system (e.g. controller 104) can instruct fluid ejection die 400 to sequentially select the next drive bubble device to undergo assessment, so long as the next selected drive bubble device has not undergone assessment. As illustrated in FIG. 4A, under this example, the next drive bubble device selected for assessment can be drive bubble device 404. If the selected column is column 406, then the next drive bubble device selected for assessment can be the drive bubble device under drive bubble device 412. If the selected column is column 408, then the next drive bubble device selected for assessment can be the drive bubble device located second from the top of column 408. If the selected column is column 410, then the next drive bubble device selected for assessment can be four drive bubble devices above drive bubble device 416.

In other examples, the fluid ejection system can select the next drive bubble device based on a patterned process. For example, the fluid ejection system (e.g. controller 104) can initially select the drive bubble devices at the top of each column can undergo assessment. After all the columns have been selected for assessment, the fluid ejection system (e.g. controller 104) determines that not all of the drive bubble devices of the columns of the fluid ejection die have undergone assessment. Based on that determination, the fluid ejection system (e.g. controller 104) can instruct fluid ejection die 400 to select column 402 for assessment again (e.g. randomly, sequentially or based on a patterned process). Additionally, the fluid ejection system (e.g. controller 104) can instruct fluid ejection die 400 to select every other drive bubble device to undergo assessment, so long as the next selected drive bubble device has not undergone Assessment. As illustrated in FIG. 4A, under this example, the next drive bubble device selected for assessment can be the drive bubble device below drive bubble device 404. If the selected column is column 406, then the next drive bubble device selected for assessment can be two drive bubble devices below drive bubble device 412. If the selected column is column 408, then the next drive bubble device selected for assessment can be the drive bubble device located third from the top of column 408. If the selected column is column 410, then the next drive bubble device selected for Assessment can be three drive bubble devices above drive bubble device 416.

In other examples, the fluid ejection system can perform multiple assessments on a drive bubble device before selecting a next column or a next drive bubble device.

Once the fluid ejection system has determined all the drive bubble devices of all the columns have undergone assessment can end. In some examples, the fluid ejection system can repeat the process once the fluid ejection system has determined all the drive bubble devices of all the columns have undergone assessment.

Figure 5:
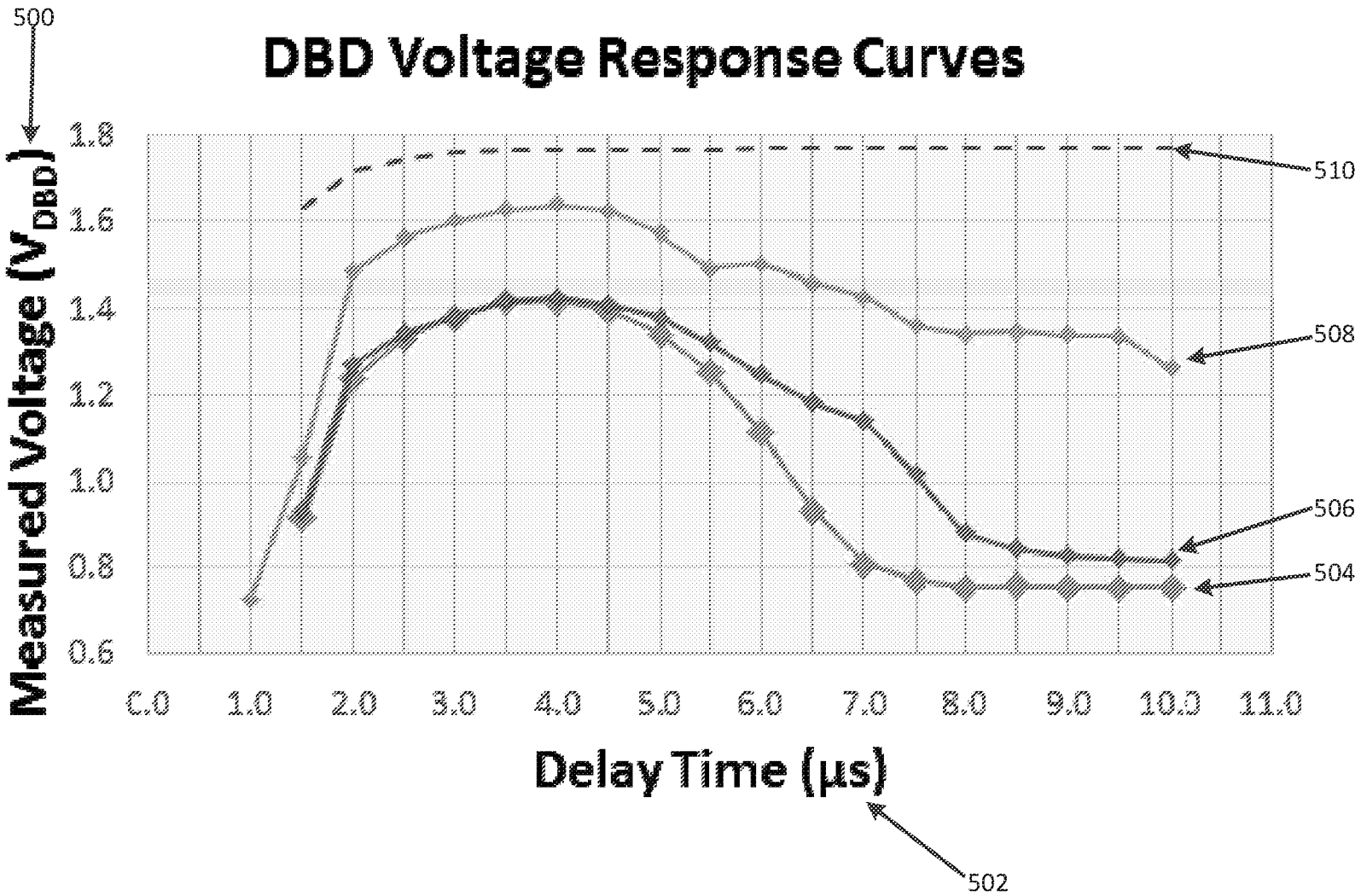
FIG. 5 illustrates example DBD (drive bubble detect) voltage response curves.

FIG. 5 illustrates example DBD voltage response curves. A signal response curve (e.g. a voltage response curve) can represent a state of operability of a drive bubble device. For example, as illustrated in FIG. 5, voltage response curve 504 represents a fully operable drive bubble device with ink. Voltage response curve 506 represents a drive bubble device with ink that is 60% blocked (e.g. a drive bubble device with a nozzle that is 60% blocked). Voltage response curve 508 represents a drive bubble device with ink that is ⅔ blocked (e.g. a drive bubble device with an ink intake channel that is ⅔ blocked). Voltage response curve 510 represents a drive bubble device that only has air in the drive bubble device. In some examples, the signal response curve can be based on the time the signal response curve was detected and the magnitude of the signal response. For example, as illustrated in FIG. 5, the voltage response curves are based on the time the response voltages were detected 502 and measured voltage(s) 500 of the detect voltage response.

In some examples, controller 104 can compare the data of signal responses (transmitted from DBD 102) to a signal response curve representing a fully functioning drive bubble device (e.g. voltage response curve 404). For example, controller 104 determines that the data of voltage responses is similar to the voltage response curve 504. Based on the comparison, controller 104 can determine that the DBD assessed drive bubble device 108 is working properly. In another example, controller 104 determines that the data of voltage responses is different than the voltage response curve 504. Based on the comparison, then controller 104 can determine that the DBD assessed drive bubble device 108 is not properly working.

In other examples, controller 104 can compare the data of signal responses to signal response curve representing a drive bubble device not working properly (e.g. voltage response curve 506 or 508). For example controller 104 determines that the data of voltage responses is similar to the voltage response curves 506 or 508. Based on the comparison, controller 104 can determine that drive bubble device 108 is working similar to the state of operability that the compared voltage response curve represents (e.g. voltage response curve 506 represents a drive bubble device with ink that is 60% blocked, while voltage response curve 508 represents a drive bubble device with ink that is ⅔ blocked).

In some examples, controller 104 can store the signal response curve representing a fully functioning drive bubble device. In other examples, controller 104 can store the signal response curve(s) of a drive bubble device not working properly. In yet other examples, controller 104 can store the signal response curves representing both a fully functioning drive bubble device and a drive bubble device that is not working properly.

Although specific examples have been illustrated and described herein, it will be appreciated by those of ordinary skill in the art that a variety of alternate and/or equivalent implementations may be substituted for the specific examples shown and described without departing from the scope of the present invention. This application is intended to cover any adaptations or variations of the specific examples discussed herein. Therefore, it is intended that this invention be limited only by the claims and the equivalents thereof.

What is claimed is:

1. A fluid ejection system comprising:

a fluid ejection die comprising one or more drive bubble devices and a sensor for each drive bubble device of the one or more drive bubble devices to detect a characteristic of each drive bubble device; and a controller configured to:

evaluate a first drive bubble device of the one or more drive bubble devices; and during the evaluation of the first drive bubble device, service another drive bubble device of the one or more drive bubble devices.

2. The fluid ejection system of claim 1, wherein the sensor is operatively communicating with the controller to transmit the detected characteristic of the first drive bubble device to the controller in order for the controller to evaluate the one or more drive bubble devices.

3. The fluid ejection system of claim 2, wherein the characteristic includes one or more signal responses.

4. The fluid ejection system of claim 3, wherein the evaluation of the first drive bubble device further comprises:

driving one or more stimuli into a conductive pad operatively connected to the first drive bubble device;

detecting one or more response signals, based on the driven one or more stimuli;

comparing the one or more response signals to a signal response curve; and determining a state of operability of the first drive bubble device.

5. The fluid ejection system of claim 2 wherein the sensor capacitively detects the characteristic.

6. The fluid ejection system of claim 1, wherein each drive bubble device includes:

a nozzle; and a heating component to eject fluid out of the nozzle.

7. The fluid ejection system of claim 1; wherein the evaluation of the first drive bubble device includes, selecting the first drive bubble device to be evaluated from a plurality of drive bubble devices in a first column of drive bubble devices.

8. The fluid ejection system of claim 1, wherein the controller is further configured to:

evaluate a second drive bubble device of the one or more drive bubble devices; and during the evaluation of the second drive bubble device, service the first drive bubble device of the one or more drive bubble devices.

9. The fluid ejection system of claim 8, wherein the first drive bubble device and the second drive bubble device are different drive bubble devices.

10. The fluid ejection system of claim 1, wherein the controller is further configured to:

upload utilization data to the one or more other drive bubble devices; and upload DBD (drive bubble detect) data to the first drive bubble device, the DBD data including firing instructions.

11. The fluid ejection system of claim 10, wherein the utilization data includes pump data.

12. The fluid ejection system of claim 10, wherein the utilization data includes spit data.

13. A method for evaluating a fluid ejection die, the method comprising:

evaluating a first drive bubble device; and during the evaluation of the first drive bubble device, servicing another drive bubble device.

14. A printer system comprising:

a fluid ejection die comprising a plurality of drive bubble devices in a first column, a plurality of drive bubble devices in a second column, and a sensor for each drive bubble device to detect a characteristic of each drive bubble device; and a controller configured to:

evaluate a first drive bubble device in the first column; and service drive bubble devices in the second column responsive to initiating evaluation of the first drive bubble device.

15. The printer system of claim 14, wherein the controller is further configured to:

evaluate a second drive bubble device in the second column; and service the drive bubble devices in the first column responsive to initiating evaluation of the second drive bubble device.

16. The printer system of claim 15, wherein the drive bubble devices in the first column and in the second column are evaluated in round-robin fashion.

17. The printer system of claim 16, wherein the drive bubble devices in the first column and in the second column are evaluated in round-robin fashion until all drive bubble devices have been evaluated.

* * * * *